US005328380A

United States Patent [19]

Carney

[11] Patent Number: 5,328,380

[45] Date of Patent: Jul. 12, 1994

[54] ELECTRICAL CONNECTOR

[75] Inventor: William V. Carney, Oyster Bay, N.Y.

[73] Assignee: Porta Systems Corp., Syosset, N.Y.

[21] Appl. No.: 31,199

[22] Filed: Mar. 12, 1993

Related U.S. Application Data

[63] Continuation-in-part of Ser. No. 904,705, Jun. 26, 1992, abandoned.

[51] Int. Cl.[5] ..... H01R 13/658

[52] U.S. Cl. ..... 439/188; 439/608; 439/610; 200/51.09

[58] Field of Search ..... 200/51.09, 51.1; 439/188, 287, 289-291, 295, 507, 513-515, 607-610

[56] References Cited

U.S. PATENT DOCUMENTS

| | | | |
|---|---|---|---|
| Re. 32,760 | 10/1988 | Chandler et al. | 439/188 |
| 2,747,049 | 5/1956 | Johansson | 200/51.1 |
| 3,399,372 | 4/1968 | Uberbacher . | |
| 4,274,691 | 6/1981 | Abernethy et al. . | |
| 4,405,187 | 9/1983 | Miller et al. . | |
| 4,412,715 | 11/1983 | Bogese II . | |
| 4,501,459 | 2/1985 | Chandler et al. . | |
| 4,602,833 | 7/1986 | Grabbe et al. . | |
| 4,619,494 | 10/1986 | Noorily et al. . | |
| 4,653,825 | 3/1987 | Olsson . | |
| 4,671,599 | 6/1987 | Olsson | 439/188 |
| 4,682,836 | 7/1987 | Noorily et al. | 439/426 |
| 4,711,507 | 12/1987 | Noorily | 439/292 |
| 4,744,769 | 5/1988 | Grabbe et al. | 439/284 |
| 4,756,695 | 7/1988 | Lane et al. | 439/76 |
| 4,846,727 | 7/1989 | Glover et al. | 439/608 |
| 4,859,201 | 8/1989 | Marsh | 439/290 |
| 4,863,393 | 9/1989 | Ward et al. | 439/188 |
| 4,883,433 | 11/1989 | Lane | 439/607 |
| 4,884,981 | 12/1989 | Chandler et al. | 439/610 |
| 4,891,022 | 1/1990 | Chandler et al. | 439/610 |
| 4,975,084 | 12/1990 | Fedder et al. | 439/608 |
| 5,009,616 | 4/1991 | Fogg et al. | 439/608 |
| 5,030,121 | 7/1991 | Noorily | 439/188 |
| 5,057,038 | 10/1991 | Bowen et al. | 439/497 |
| 5,074,801 | 12/1991 | Siemon | 439/188 |
| 5,160,273 | 11/1992 | Carney | 439/108 |
| 5,190,464 | 3/1993 | Chow et al. | 439/188 |
| 5,195,902 | 3/1993 | Bengal | 439/188 |

FOREIGN PATENT DOCUMENTS 0403370 12/1990 European Pat. Off. .

*Primary Examiner*—Gary F. Paumen

*Attorney, Agent, or Firm*—Fitzpatrick, Cella, Harper & Scinto

[57] ABSTRACT

An electrical connector for connecting together cables containing at least two twisted wire pairs which transmit and receive different electrical signals, The connector has an electrically conductive shield between pairs of connector elements which are respectively connected to the different twisted wire pairs. The connector also has an insulative block with printed circuit segments and switch contacts which together form shunts to connect the twisted pairs together when the connector is disconnected.

26 Claims, 10 Drawing Sheets

FIG. 14
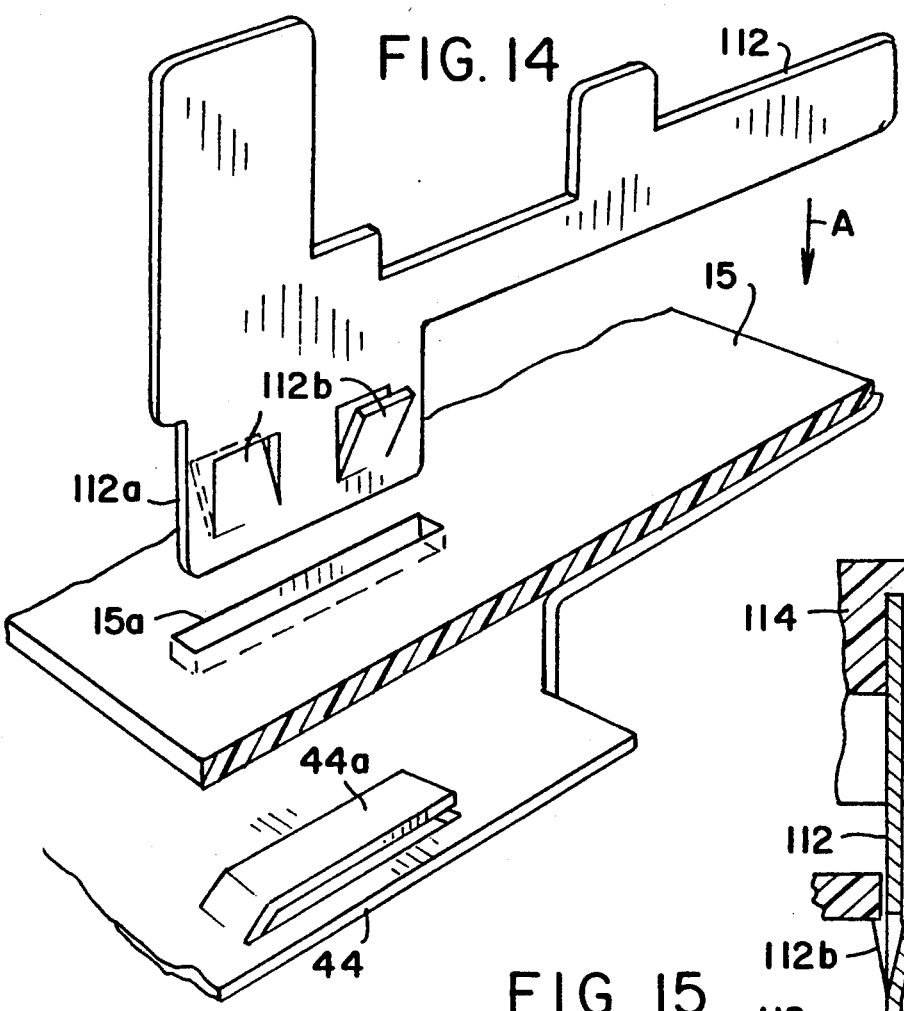
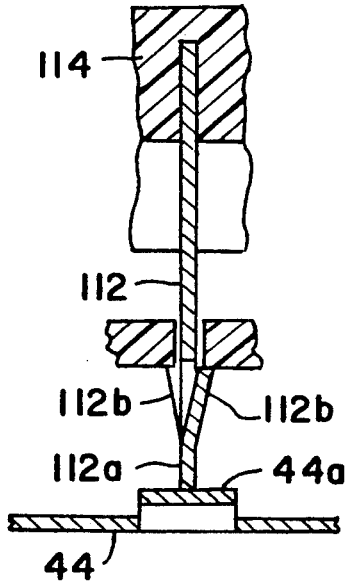
FIG. 15
FIG. 16
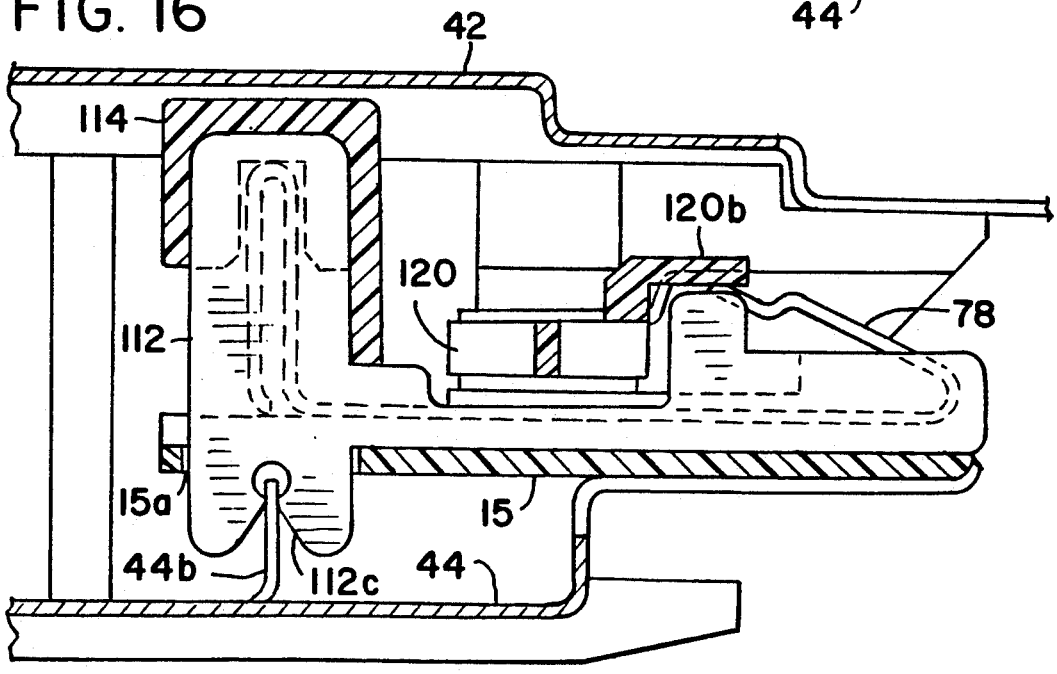

ELECTRICAL CONNECTOR

CROSS-REFERENCE TO RELATED APPLICATIONS

This is a continuation-in-part of copending U.S. patent application Ser. No. 07/904,705, filed Jun. 26, 1992, now abandoned, in the name of William V. Carney.

BACKGROUND OF THE INVENTION

1. Field of the Invention

This invention relates to electrical connectors and in particular it concerns a novel data connector for connecting together pairs of electrical conductors which carry different electrical signals.

2. Description of the Prior Art

Electrical connectors for making electrical connections between cables which carry data or twisted wire pairs are well known. Such connectors are often used to connect computer terminals into local area network systems. Examples of such connectors are shown in U.S. Pat. Nos. Re. 32,760, 4,761,599, 4,682,836, 4,891,022, 5,030,121 and 4,884,981.

These patents show various ways to shunt the twisted wire pairs when the connector is disconnected and they also show electrical shielding arrangements to protect against radiation to and from the connector which could interfere with the high frequency signals carried therein.

The prior art however does not provide any protection against crosstalk or mutual interference within the connector itself. Also, the prior art self shunting arrangements require all of the connector elements to make and break electrical contact which unnecessarily complicates the structure and operation of the connector.

SUMMARY OF THE INVENTION

In aspect, the present invention provides a novel electrical connector which minimizes crosstalk between pairs of conductors which carry different electrical signals. This novel connector comprises a housing having a cable receiving region and a connection region. A clamp is located in the cable receiving region for clamping the outer casing of a cable to the housing. A plurality of electrically conductive connector elements extend from the cable receiving region to the connection region and are positioned in side by side relationship. The connector elements each have a formation, in the cable receiving region, for making positive electrical contact with an associated wire from within the cable. The connector elements also each have, in the connection region of the housing, a contact formation for making pressure contact with a corresponding contact of a mating connector element. An electrically conductive shield extends between adjacent connector elements and extends from a location near the clamp to the contact formations of the connector elements and has a surface which extends over substantially the entire mutually projected area of the adjacent connector elements. Thus when the electrical connector is connected to another connector and the connector elements on opposite sides of the shield carry different high frequency signals, the signals do not interfere with each other because the shield prevents radiation from the connector elements on one side thereof from passing over to the connector elements on the other side.

In another aspect, the present invention provides a novel electrical connector which provides self shunting in a manner that does not require the complicated multiple moveable contacts of the prior art. This novel electrical connector comprises a housing and at least two pairs of connector elements extending in side by side relationship within the housing. One end of each of the connector elements is arranged to be electrically connected to a wire from a cable extending to the housing. The other end of each connector element is bent back to form a deflectable tongue which, when connected a mating connectors becomes deflected by contact with a mating connector element. An insulative block extends across each of the connector elements between their respective ends. First and second switch contacts are mounted on the insulative block and extend over the ends of only the first and second ones of the tongues to make electrical contact therewith in the undeflected position of the tongues, but not in their deflected position. Circuit segments are provided on the insulative block and are arranged to form a first permanent, non-breakable circuit connection between the first switch contact and one of the connector elements whose tongue does not contact a switch contact and a second permanent, non-breakable circuit connection between the second switch contact and the other connector element whose tongue does not contact a switch contact.

The arrangement of the insulative block and circuit segments facilitates the placement of a crosstalk protection shield between adjacent electrical contacts.

BRIEF DESCRIPTION OF THE DRAWINGS

FIG. 14 is an exploded perspective view of a center shield arrangement used in the embodiment of FIG. 7;

FIG. 15 is a view taken along line 15—15 of FIG. 14 but showing the shield arrangement in assembly; and FIG. 16 is a view similar to FIG. 7 but showing an alternate center shield arrangement.

DETAILED DESCRIPTION OF THE PREFERRED EMBODIMENTS

Although the invention is not so limited, it is well suited for use in hermaphroditic type electrical connectors. These connectors are of a special shape which permit connection between two identically shaped connectors when one is inverted with respect to the other.

Figure 1:
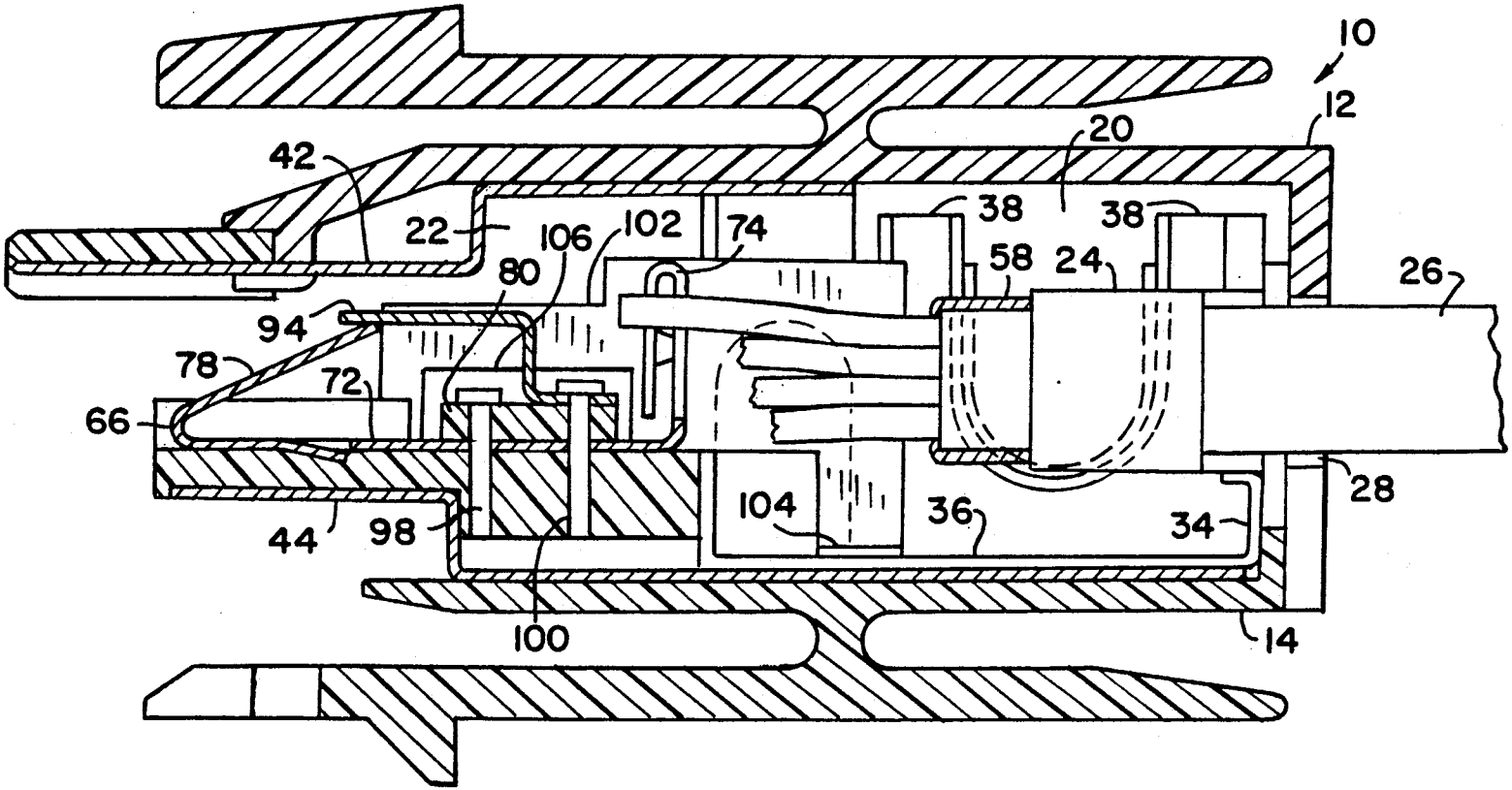
FIG. 1 is a side elevational view, in section, of an electrical connector according to the present invention.

As shown in FIG. 1, an electrical connector 10 has a housing formed of a top portion 12 and a bottom portion 14 of molded plastic. These housing portions have attachment wings 16 and 18 of well known configuration for locking the connector to a mating connector. The housing is formed with a cable receiving region 20 and a connection region 22. Inside the cable receiving region 20 there is provided a cable clamp, in the form of a ferrule 24, which clamps an electrical cable 26 inside the housing. The cable enters the housing via an opening 28 into the cable receiving region 20. The opening 28 enters via the rear of the housing; however there are also provided openings 30 and 32 (FIG. 2) at the sides of the housing so that the cable 26 can enter from a side of the housings if desired.

A center radiation shield 34 of electrically conductive material, such as phosphor bronze, is provided in the cable receiving region 20 of the housing. The shield 34 has a flat bottom portion 36 and upwardly extending posts 38 between the openings 30 and 32. The clamp or ferrule 24 has wings 40 which fit over the posts 38 to hold it securely within the housing. If it is desired to have the cable 26 enter the housing via one of the openings 30 or 32, the wings 40 of the clamp or ferrule 24 would fit over the posts 38 on each side of that particular opening.

Upper and lower electrically conductive radiation shields 42 and 44 extend along the top and bottom of the cable receiving region 20 and into the connection region 22. These shields also are preferably made of phosphor bronze.

Figure 2:
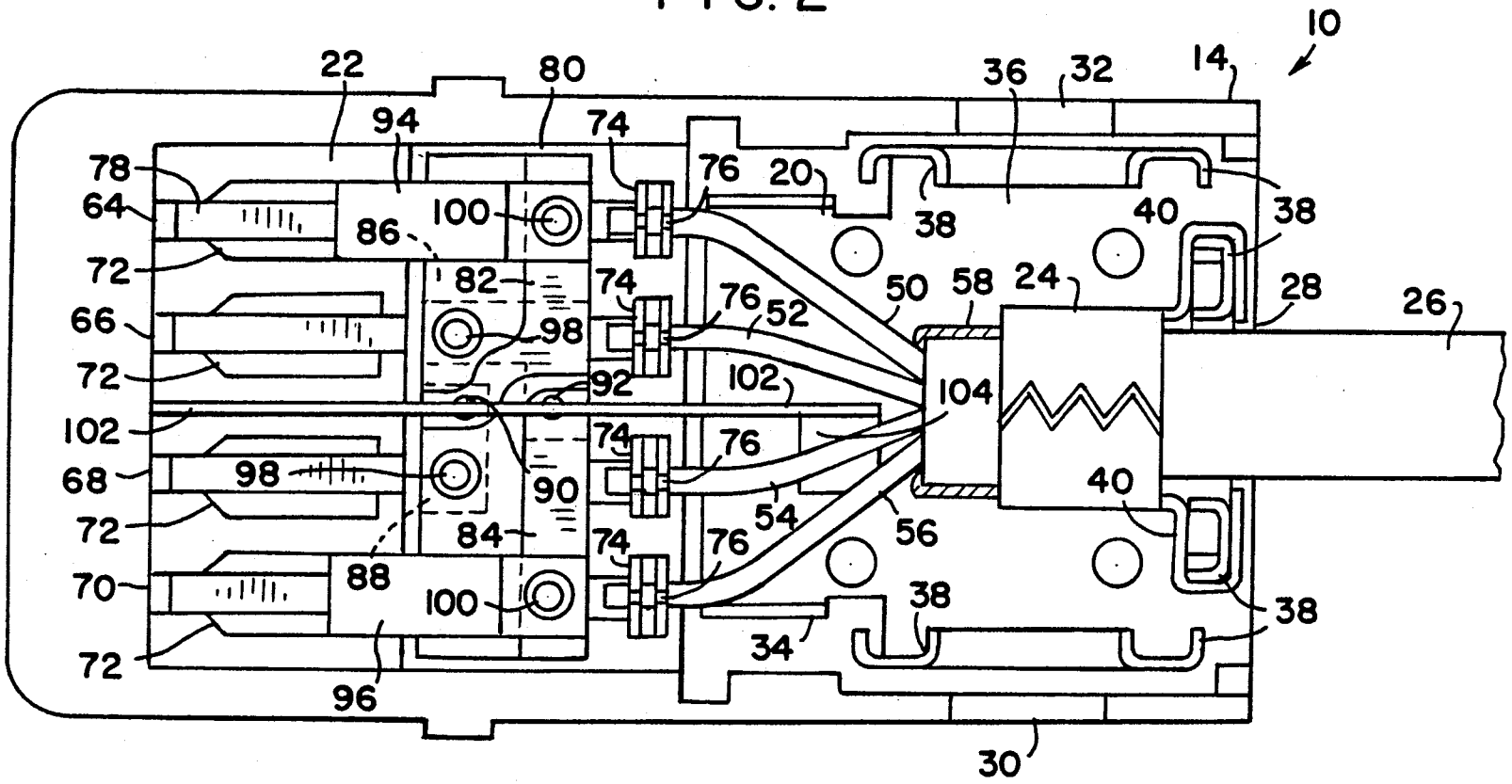
FIG. 2 is an enlarged section view taken along line 2—2 of FIG. 1.
Figure 3:
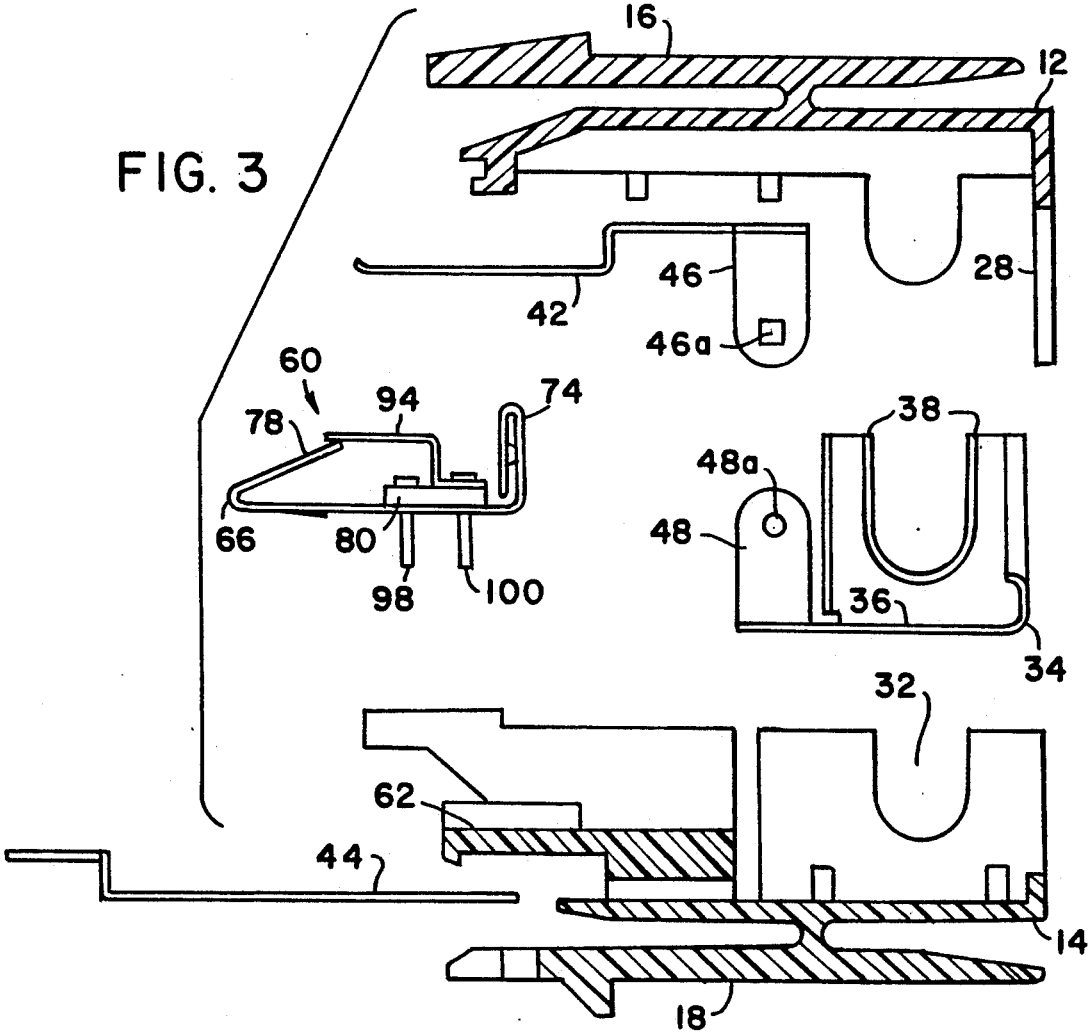
FIG. 3 is an exploded side elevational view, in section, of connector of FIG. 2.

The arrangement of the shields 34, 42 and 44 and the housing portions 12 and 14 is shown in FIG. 3. The lower radiation shield 44 extends under the center radiation shield 34 and makes direct contact with it. The upper radiation shield 42 has downwardly extending wings 46 with openings **46*a* which accommodate detents 48*a* of corresponding wings 48 of the center radiation shield 34. Thus the shields are all electrically connected to each other; and they are also electrically connected through the clamp ferrule 24 to the cable 26. The clamp or ferrule 24 is electrically conductive and preferably is made of phosphor bronze material. The cable 26 contains a pair of transmit wires 50 and 52 and a pair of receive wires 54 and 56. The transmit wires are twisted together and the receive wires are separately twisted together inside the cable to minimize radiation and crosstalk while passing different signals at high frequencies. All of the wires 50, 52, 54 and 56 are surrounded by a grounded sheath 58 inside the cable. As shown in FIG. 2, the sheath is folded back to extend under the clamp or ferrule 24. Thus, the clamp or ferrule 24 and the shields 34, 42 and 44** are connected to ground.

As can also be seen in FIG. 3, a contact assembly 60 is mounted on a shelf 62 formed in the bottom portion 14 of the housing in its connection region 22. The lower radiation shield 44 extends under the shelf 62 and is electrically isolated from the contact assembly 60.

Figure 4:
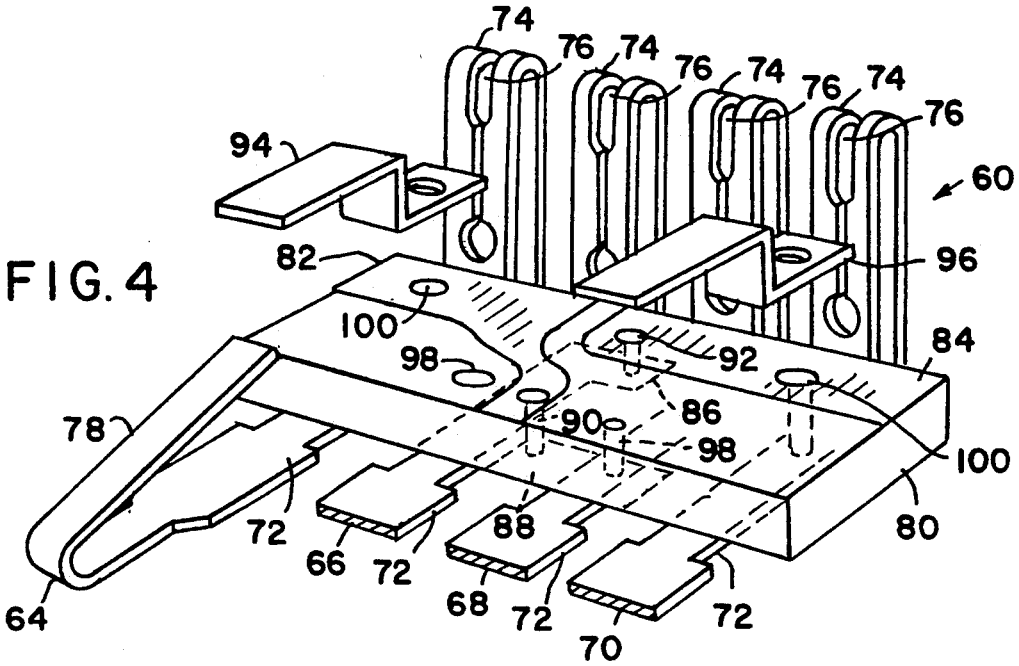
FIG. 4 is a fragmentally exploded perspective view of a connector and shunting arrangement of FIG. 3.

The construction of the contact assembly 60 is shown in the enlarged perspective view of FIG. 4. As can be seen, the assembly comprises four connector elements 64, 66, 68 and 70 of identical configuration. These connector elements are made of electrically conductive strip material, such as phosphor bronze, which is spring tempered. Each connector element has a central portion 72 which extends from the cable receiving region 20 to the connection region 22 of the housing. The end of each connector element in the cable receiving region 20 is bent to a vertical U-shaped formation 74 which has a slot 76. This slot enables positive electrical contact with one of the wires 50, 52, 54 and 56 from the cable 26. The wire is pressed down into the slot 76; and the sides of the slot cut though the wire insulation to make positive electrical contact with the conductor portion of the wire. The other end of each connector element 64, 66, 68 and 70, which is in the connection region 22, is bent back to form a contact formation or deflectable tongue 78. This tongue, when pressed against a corresponding connector element of a mating connector, makes electrical contact with the corresponding connector element and at the same time is deflected downwardly by the corresponding connector element.

A printed circuit block 80 of insulative material, such as plastic or printed circuit board material, extends across the central portion 72 of each of the connector elements 64, 66, 68 and 70. On the top of block 80 are first and second printed circuit segments 82 and 84 and on the bottom of the block 80 are third and fourth printed circuit segments 86 and 88. The first and fourth segments 82 and 88 are electrically connected to each other via a first plated through hole 90 in the block; and the second and third segments 84 and 86 are electrically connected to each other via second plated through hole 92 in the block.

In assembly, as shown at FIGS. 3 and 4, the third and fourth printed circuit segments 86 and 88 on the bottom surface of the block 80 are in electrical contact with the second and third connector elements 66 and 68, respectively.

Switch contacts 94 and 96, which are made from strips of electrically conductive material, such as phosphor bronze, are attached to the top surface of the block 80 at the printed circuit segments 82 and 84, respectively, and are in electrical contact with those elements. These switch contacts extend out, in cantilever fashion, over the tongues 78 of the first and fourth connector elements 64 and 70 only; and normally remain in electrical contact with their respective contact tongues. However, when the connector 10 is connected to another connector, the tongues 78 of the connector elements 64 and 70 become deflected away from the switch contacts 94 and 96 and are electrically disconnected from them. It will be noted that the switch contacts 94 and 96 are arranged over the tongues 98 of the outermost connector elements 64 and 70 only so that they are spaced a maximum distance from each other to minimize crosstalk radiation.

The switch contacts 94 and 96 and the block 80 are held to the bottom portion 14 of the housing by means of rivets 98 and 100, as shown in FIGS. 1 and 2.

As can be seen, the printed circuit segments 82 and 88 on the block 80 form a first permanent, non-breakable circuit connection between the first switch contact 94 and the connector element 68, and the printed circuit segments 84 and 86 form a second circuit connection between the second switch contact 96 and the connector element 66. More specifically, the first switch contact 94, the first and fourth printed circuit segments 82 and 88, and the plated through hole 90, form a circuit between the tongue 78 of the first connector element 64 and the central portion 72 of the third connector element 68. Similarly, the second switch contact 96, the second and third printed circuit segments 84 and 86 and the plated through hole 92, form a circuit between the tongue 78 of the fourth connector element 70 and the central portion 72 of the second connector element 66.

Thus, when the first and second switch contacts 94 and 96 are in contact with their respective contact element tongues 78, as is the normal condition when the electrical connector 10 is disconnected from another connector, the first and third connector elements 64 and 68 are shunted to each other and the second and fourth connector elements 66 and 70 are shunted to each other.

As shown in FIGS. 1 and 2, a thin flat shield 102 of electrically conductive material, such as phosphor bronze, extends in a vertical plane between the connector elements 66 and 68 from a location near the clamp or ferrule 24 to the tongue end of the connectors. The shield 102 is formed with a flange 104 at the rear of its bottom edge; and this flange is secured to the flat bottom wall 36 of the center radiator shield 34. The surface of the shield 102 extends over substantially the entire mutually projected area of the adjacent connector elements 66 and 68, including their vertical U-shaped formations 74 and the forward portions of their tongues 78. As can be seen in FIG. 1, the shield 102 has a cut out region 106 through which the block 80 extends.

The wires 50 and 52 in the cable 26 constitute a transmit pair while the wires 54 and 56 constitute a receive pair. The wires of each pair, 52–54 and 54–56, are twisted together inside the cable 26 to minimize radiation and to prevent interference from externally generated radiation so that signal crosstalk is avoided. However, where the wires emerge from the cable 26 and extend to the connector elements 64, 66, 68, and 70, they are not twisted; and the connector elements themselves are not twisted. Therefore, within the connector 10 itself there is a potential for crosstalk or interference from the transmit wires 50–52 and their respective connector elements 64–66 to the receive wires 54–56 and their respective connector elements 68–70. The shield 102 occupies the region between the cable 26 and the tongues 78 of the connector elements between the transmit and receive pairs and prevents radiation from one pair to the other.

Figure 5:
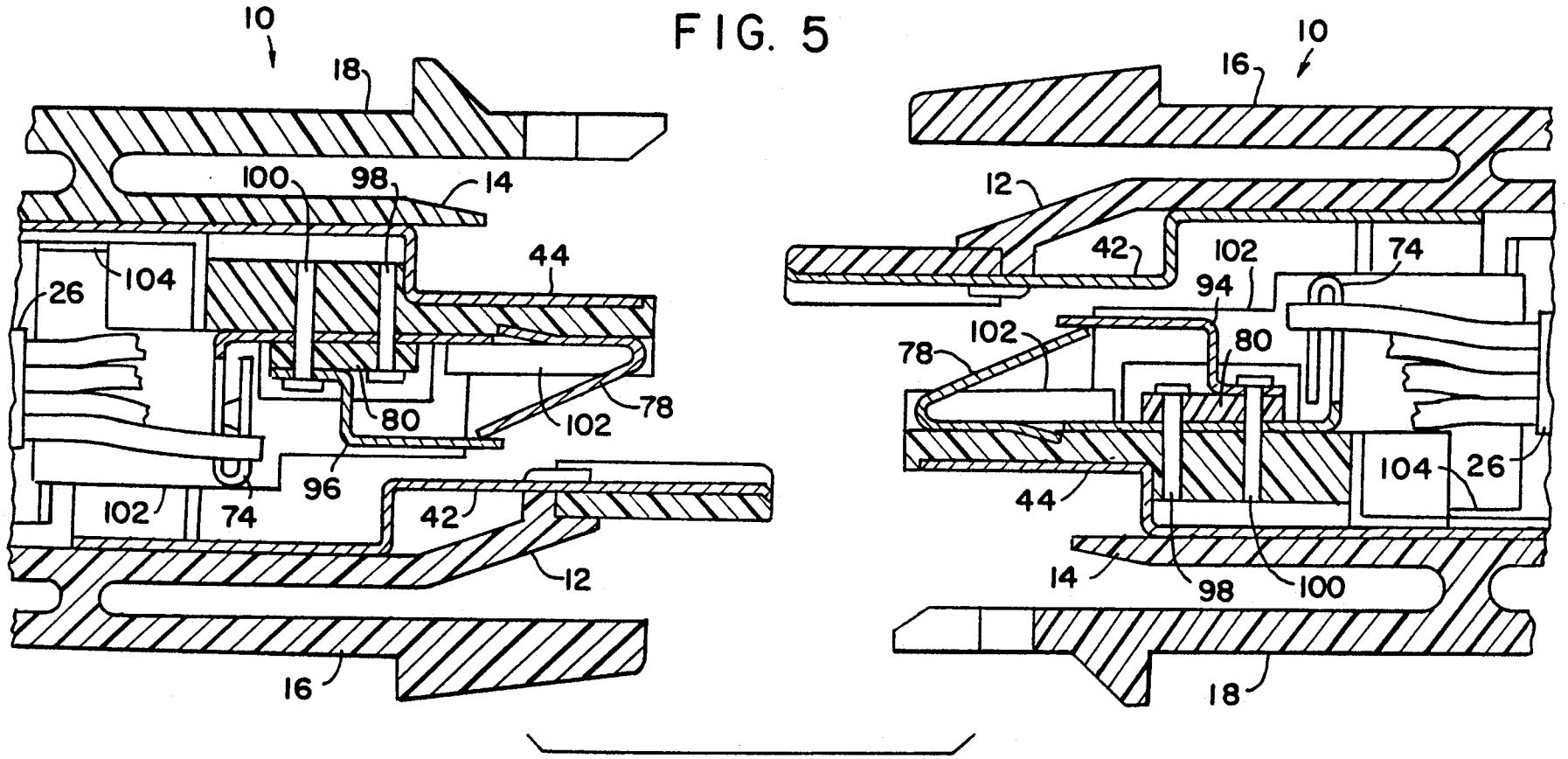
FIG. 5 is a side elevational view, in section, of two connectors, such as shown in FIG. 2, about to the be connected to each other.
Figure 6:
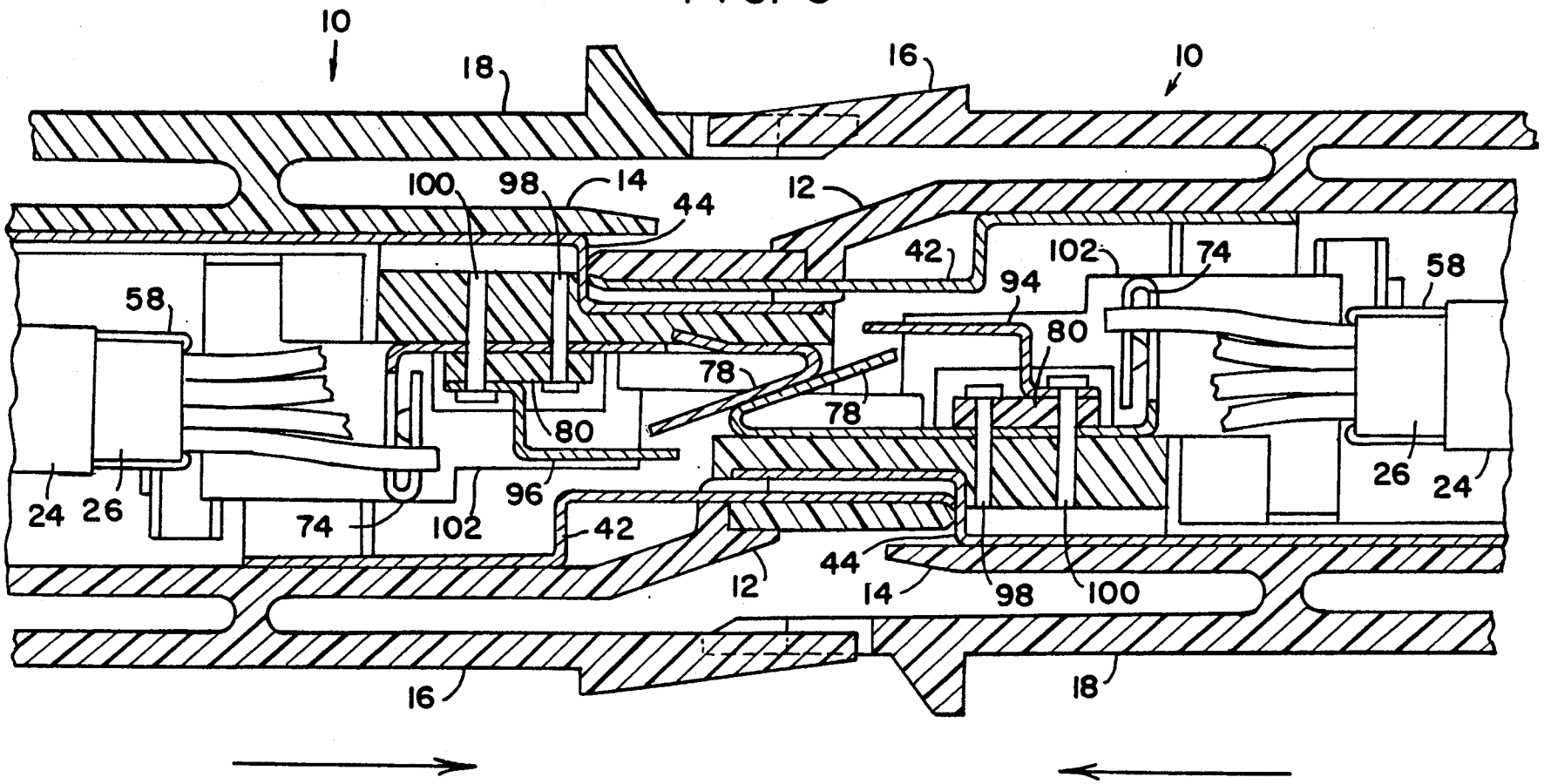
FIG. 6 is a view similar to FIG. 5 and showing the connectors fully connected to each other.

FIGS. 5 and 6 show a pair of the above described connectors 10 positioned ready to be connected to each other. The connectors are identical in configuration; however since this configuration is hermaphroditic, they readily connect to each other, with the tongues 78 of one connector making pressure contact with the tongues 78 of the other connector. This pressure contact ensures good electrical connection; and as can be seen, it causes the tongue 78 of each connector element to be deflected; and the tongues 78 of the connector elements 64 and 70 also break contact with the associated switch contact 94 and 96.

As shown in FIG. 5, when the connectors 10 are disconnected from each other, the tongues 78 of the connector elements 64 and 70 contact their respective switch contacts 94 and 96 and the transmit wires 50–52 are shunted to the receive wires 54–56. However when the connectors 10 are connected to each other as in FIG. 6, the contacting tongues 78 deflect each other away from their respective switch contacts 94 and 96 so that the shunt connections are broken; and the connections from the wires 50–52 and to the wires 54–56 are through the mating connector 10.

It will be appreciated that the shunt connections are made and broken by movement of only one switch element in the transmit pair of each connector and one switch element in the receive pair. In the prior art, separate connections for each wire were made and broken when the connectors 10 were connected and disconnected. It will also be appreciated that the arrangement of the printed circuit board, which brings the shunt connection from the tongue 78 of one connector element to the central portion 72 of another connector element, provides a compact and secure arrangement which also minimizes radiation and crosstalk and permits the shield 102 to be configured with the maximum area so that the shielding effect of the shield 102 itself is maximized. As can be seen, the shield 102 extends from a location near the clamp 24 to the ends of the tongues 78 on the contacts 66 and 68; and the surface of the shield extends over substantially the entire mutually projected area of the adjacent contacts 66 and 68.

The shields 34, 42, 44 and 102 as well as the switch contacts 94 and 96 and the clamp or ferrule 24 are all preferably made of phosphor bronze strip alloy. A C51000 spring or extra spring temper with a thickness of about 0.016 inches (4 mm) and a bright solder plate 60/40 finish MIL-P-81728, 0.0002 inches (0.005 mm) thick. The connector elements 64, 66, 68 and 70 are preferably of the same material but are preferably 0.012 inches (3 mm) thick.

Figure 7:
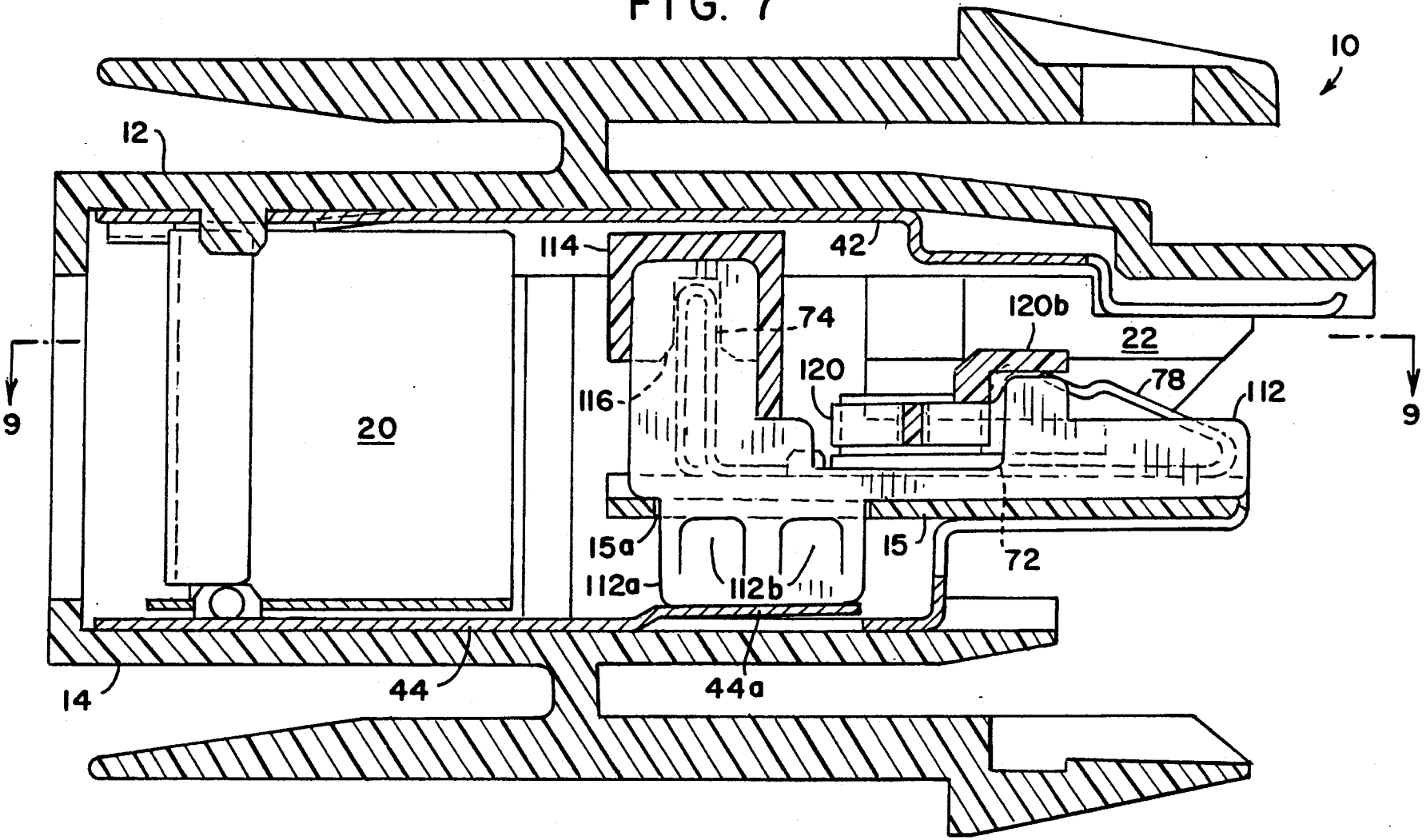
FIG. 7 is an elevational view, in section along the center thereof, of a second embodiment of the electrical connector of the present invention.

The connector of FIG. 7 has the same overall construction as that of FIGS. 1 to 6. Accordingly only those features which differ from the preceding embodiment will be described. As in the previous embodiment, the connector elements 64, 66, 68 and 70 are mounted on the bottom portion of the housing 14. Actually, as shown, there is formed a shelf 15 which extends across and is molded integrally with the bottom portion 14 of the housing; and the connector elements rest on this shelf. The shelf 15 is formed with a slot 15*a* extending longitudinally along the center of the shelf. An electrically conductive center shield 112 is mounted to stand upright on the shelf 15 between the connector elements 66 and 68 so that one pair of connector elements 64 and 66, along with the switch contact 94, are on one side of the shield 112 and the other pair of connector elements 68 and 70, along with the switch contact 96, are on the other side of the shield 112 (see FIG. 9). The shield 112 is formed with a bottom extension 112*a* which extends through the slot 15*a* in the shelf 15. As can be seen, the bottom edge of the extension 112*a* presses down on a tab 44*a* which is bent up from the bottom shield 44. This provides electrical communication between the bottom and center shields. The center shield 112 is formed with bent out tabs 112*b* which extend out from the bottom extension just under the shelf 15 to lock the center shield in place and ensure that it remains in positive electrical contact with the bottom shield tab 44*a*. The upper portion of the center shield 112 is shaped the same as the center shield 102 in the preceding embodiment.

The fragmentary perspective views of FIG. 14 and 15 illustrate how the center shield 112 is mounted. As can be seen in FIG. 14, the center shield is pressed down in the direction of the arrow A to force its bottom extension 112*a* into the slot 15*a* of the shelf 15 while the tabs 112*b* flex in to pass through the slot. Thereafter the tabs 112*b* flex out as shown in FIG. 15 to lock the shield in place. As can be seen, in this position, the bottom extension presses down on the tab 44*a* which is bent up from the bottom shield 44. Thus, the center shield 112 is maintained in positive electrical contact with the bottom shield 44.

Figure 8:
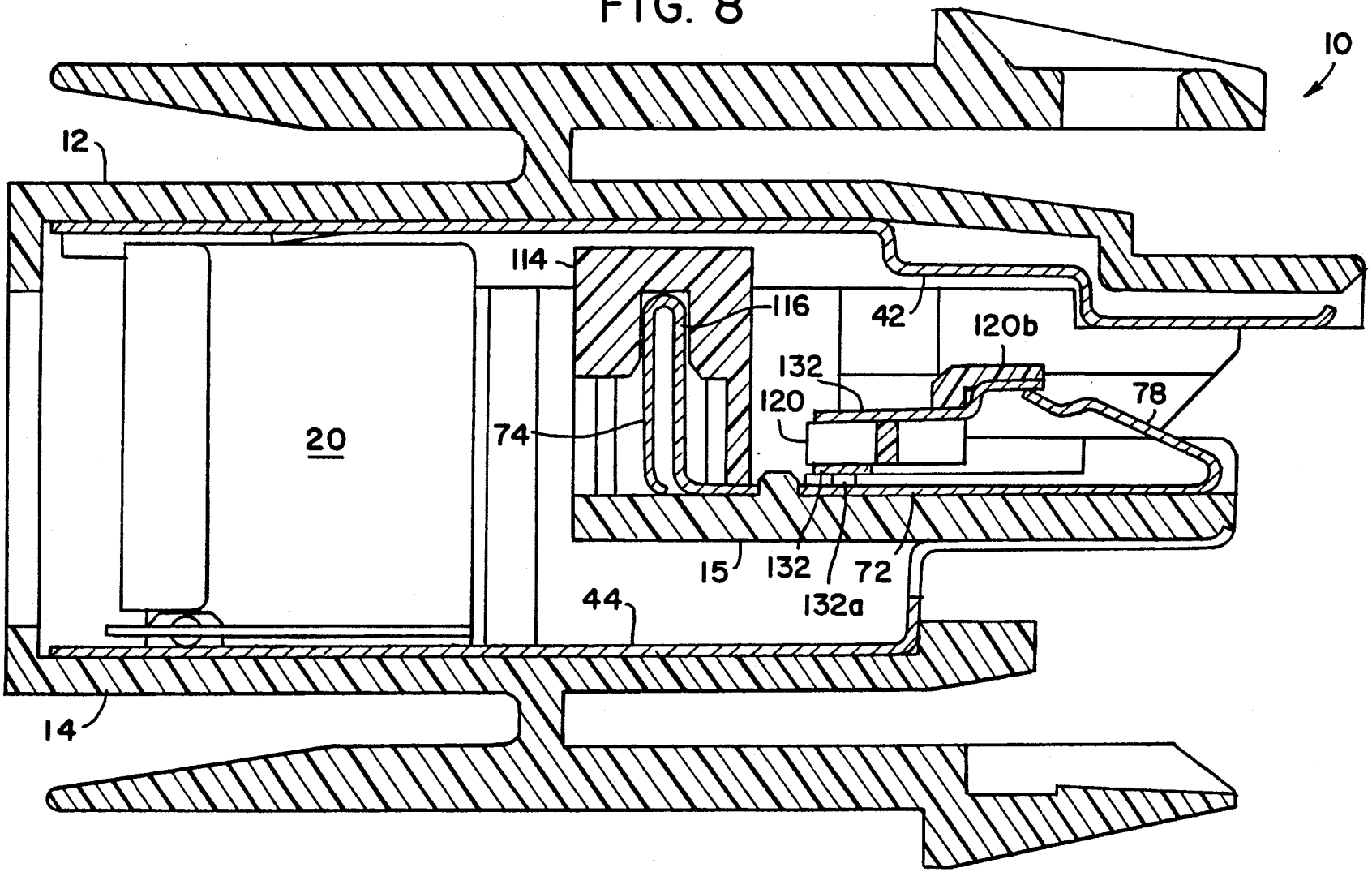
FIG. 8 is a view similar to FIG. 7 but in section offset from the center thereof.
Figure 9:
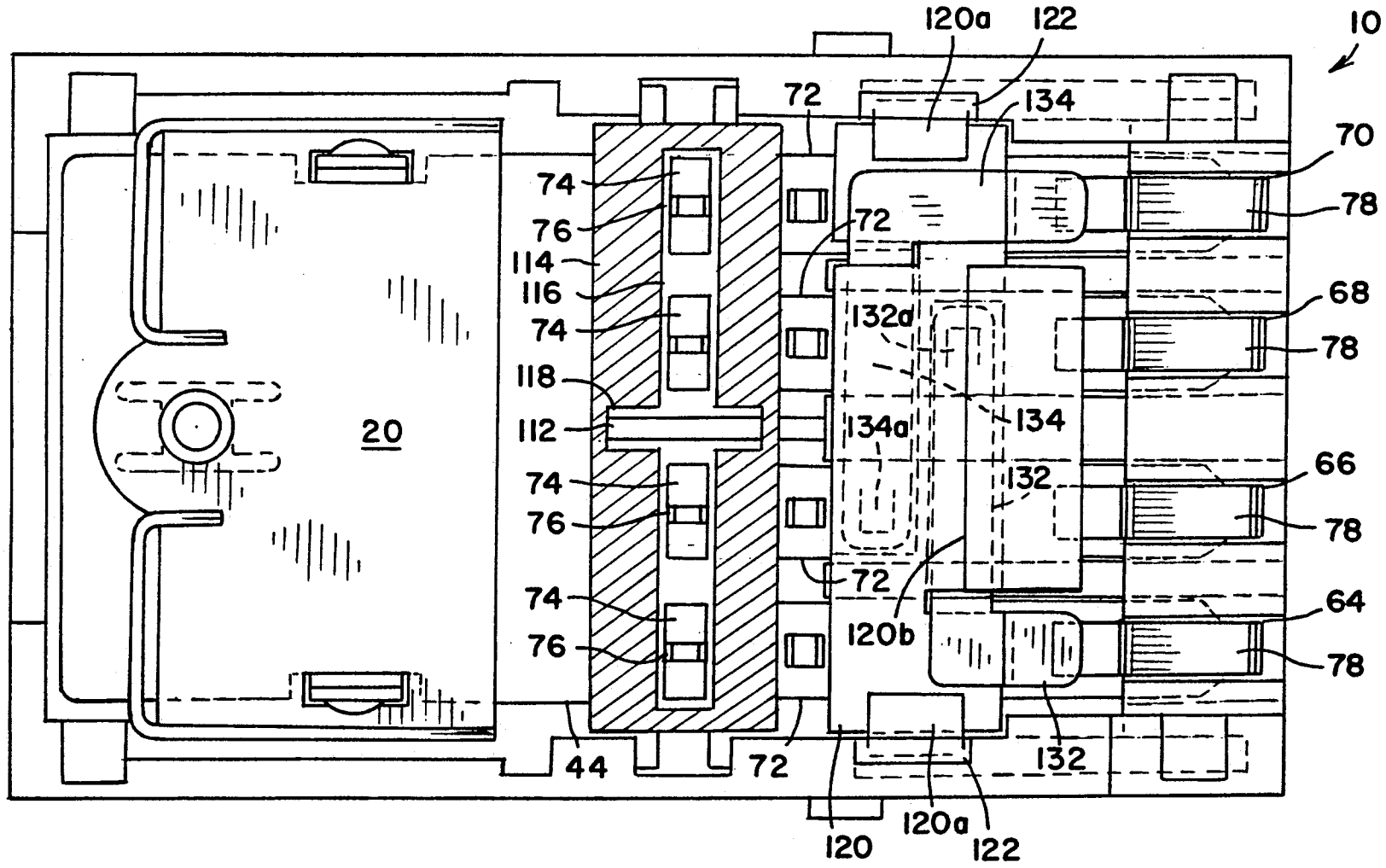
FIG. 9 is a view taken along line 9—9 of FIG. 7.

Reverting now to FIGS. 7, 8 and 9, there is shown a push down block 114 which extends down over the vertical U-shaped formations 74 of the connector elements 64, 66, 68 and 70. As can be seen in FIG. 9, the push down block has a clearance 116 into which the U-shaped portions 74 closely fit. This allows the push down block 114 to be pushed down over the U-shaped formations 74 of the connector elements; and when wires are laid over the tops of these formations, the downward movement of the block will force the wires into the slots 76 so that they will be connected simultaneously to the connector elements 64, 66, 68 and 70. The push down block 114 also has a clearance 118 formed in the center thereof to allow the center shield 112 to fit in between the pairs of vertical U-shaped formations.

Figure 10:
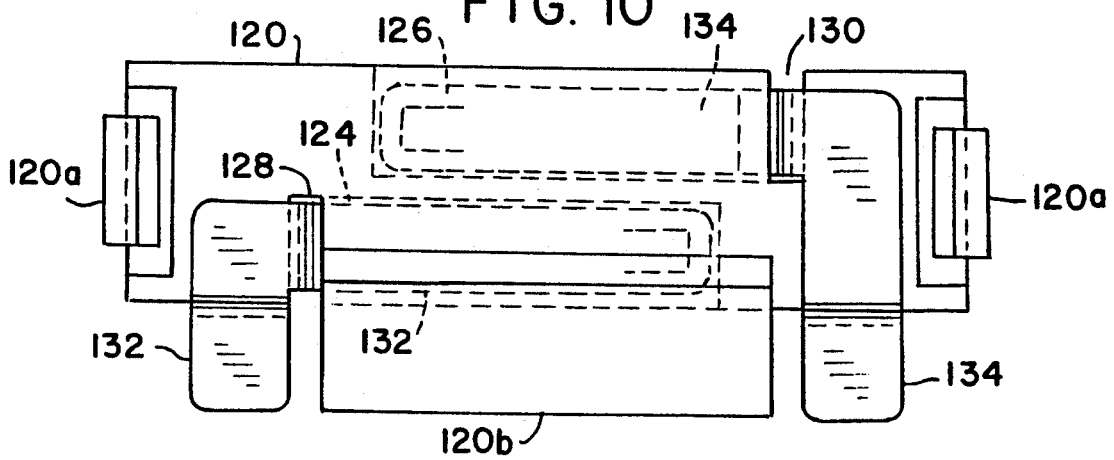
FIG. 10 is a top view of a switch contact assembly of the embodiment of FIG. 7.
Figure 11:
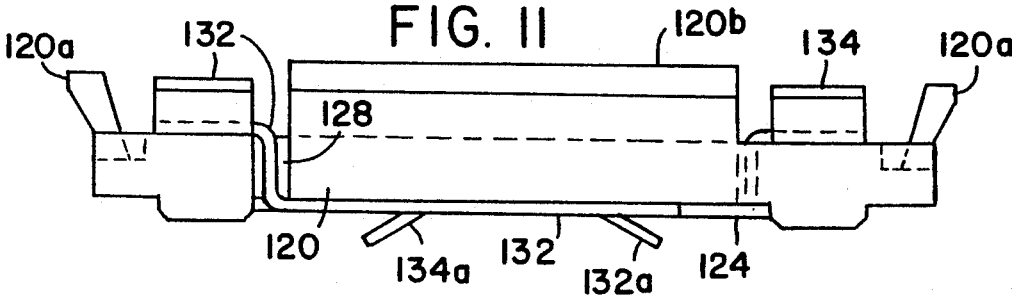
FIG. 11 is a front elevational view of the switch contact assembly of FIG. 10.
Figure 12:
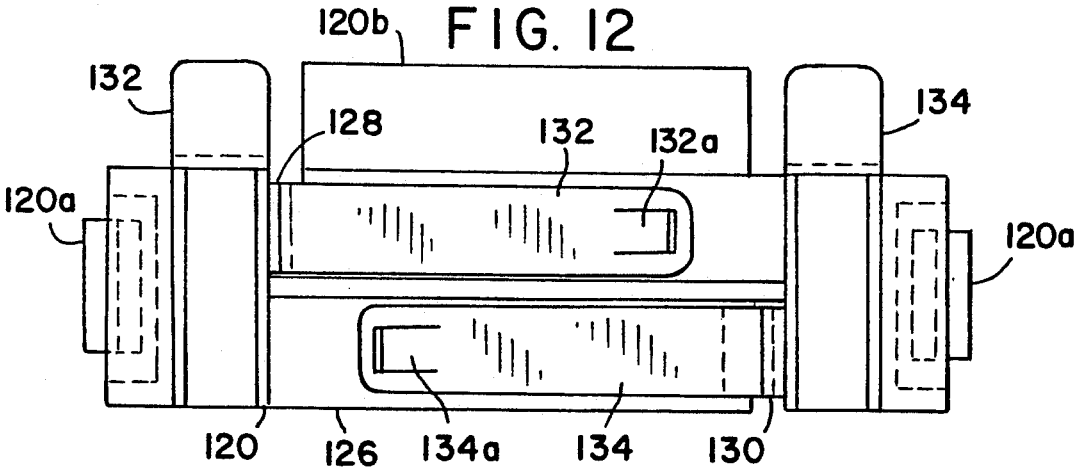
FIG. 12 is a bottom view of the switch contact assembly of FIG. 10.

As shown in FIGS. 9–13, a connector block 120 extends across the bottom portion 14 of the housing 10 just above the shelf 15. As can be seen in FIGS. 10 and 11, the connector block 120 has wing-like formations 120*a* on its ends which fit into slots 122 formed in the sides of the bottom portion 14 of the housing 10. The connector block 120 is made of an insulative material such as plastic. As can be seen in FIG. 12, the connector block 120 is formed with forward and rearward recesses 124 and 126 along the forward and rearward portions, respectively, of its lower surface. At the left end of the forward recess 124, and at the right end of the rearward recess 126, as shown in FIG. 10, there are formed slots 128 and 130 respectively, leading to the upper surface of the block. Electrically conductive forward and rearward switch contact elements 132 and 134 are fitted into the recesses 124 and 126 and extend up through respective slots 128 and 130 to the upper surface of the block 120 as shown in FIG. 11. These switch contact elements are cut from electrically conductive sheet metal, such as phosphor bronze and bent in the manner shown and described herein to fit around the connector block 120. At the upper surface of the block, each switch contact element is bent up to extend above and parallel to the block 120 and out forwardly of the block to the same positions as the switch contacts 94 of the preceding embodiment. The switch contact elements 132 and 134 normally contact the deflectable tongues 78 of the outermost connector elements 64 and 70, respectively. As can be seen, the block 120 itself is formed with a forwardly extending shelf 120*b* which is located between and at the same level as the ends of the switch contact elements 132 and 124. The tongues 78 of the innermost connector elements 66 and 68 contact the underside of the shelf 120*b*.

The bottoms of the switch contact elements 132 and 134 within the recesses 123 and 126 are formed with bent down tabs 132*a* and 134*a*. These tabs are located at the position of and contact, respectively, the central portions 72 of the innermost connector elements 66 and 68 when the block 120 is pressed down into position in the bottom portion of the housing 10. Thus it will be seen that when the connector 10 is disconnected and the tongues 78 of the connector elements 64, 66, 68 and 70 are in their normal unstressed position, the connector 66 is connected at its central portion 72 to the forward switch contact element 132 which in turn contacts the tongue 78 of the connector 70; and the connector 69 is connected at its central portion 72 to the rearward switch contact element 134 which in turn contacts the tongue 78 of the connector 68. In this manner the connectors 64 and 68 are normally connected to each other and the connectors 66 and 70 are normally connected to each other. When the connector 10 is connected with another like connector, the contacting tongues 78 of the two connectors press their counterparts on down and thereby break the connections with the switch contact elements 132 and 134 as in the preceding embodiment.

Figure 13:
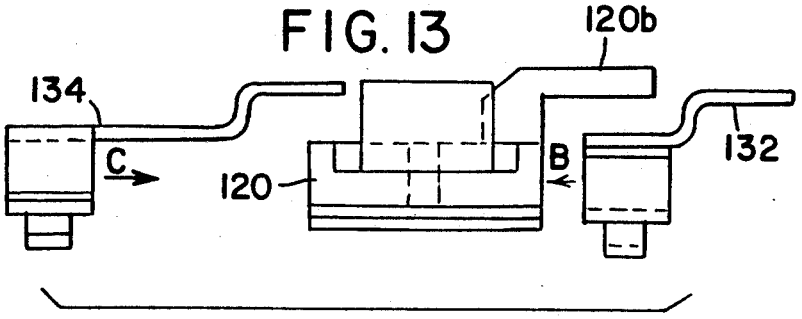
FIG. 13 is an exploded side view of the switch contact assembly of FIG. 10.

FIG. 13 shows how the switch contact elements 132 and 134 are fitted to the block 120. The forward contact element is pressed back from in front of the block, in the direction of the arrow B and the rearward contact element is pressed forwardly from behind the block, in the direction of the arrow C. The natural resiliency of the elements 132 and 134 hold them in place.

FIG. 16 shows another center shield arrangement wherein the bottom extension 112*a* of the center shield 112 is formed with a V-slot 112*c* which accommodates a vertically bent up element 44*b* on the bottom shield 44. This electrically connects the center shield 112 with the bottom shield 44 but avoids the use of resiliency in maintaining the contact. The overall construction of the shields 112 and 44 is the same as in the preceding embodiments.

I claim:

1. An electrical connector for minimizing crosstalk between pairs of conductors which carry different electrical signals therein, said connector comprising:

a housing having a cable receiving region and a connection region, a clamp located in said cable receiving region for clamping the outer casing of a cable to said housing, a plurality of electrically conductive connector elements extending from said cable receiving region to said connection region and positioned in side by side relationship, said connector elements each having a formation, in said cable receiving region, for making positive electrical contact with a wire from within said cable, said connector elements also each having a contact formation, in said connection region, for making pressure contact with a connector element of a mating connector, and an electrically conductive shield extending between adjacent said connector elements and extending from a location near said clamp to the contact formations of said connector elements and having a surface which extends over substantially the entire mutually projected area of said adjacent connector elements.

2. An electrical connector according to claim 1, wherein said contact formations are bent up portions of said connector elements and are slotted to accommodate push down connection with wires extending from said clamp.

3. An electrical connector according to claim 1, wherein said shield extends between pairs of connector elements which conduct different signals.

4. An electrical connector according to claim 1, wherein said shield is electrically connected to ground.

5. An electrical connector according to claim 1, wherein an electrically conductive further shield is provided in said cable receiving region and wherein said shield is electrically connected to said further shield.

6. An electrical connector according to claim 5, wherein said shield is formed with a flange at its lower edge, said flange being secured to said further shield.

7. An electrical connector according to claim 6, wherein said further shield is electrically connected to said clamp.

8. An electrical connector according to claim 7, wherein said clamp is arranged to be connected to a grounded sheath on said cable.

9. An electrical connector according to claim 5, wherein said connector elements are supported on a shelf and said further shield extends under said shelf.

10. An electrical connector according to claim 9, wherein said shield has a bottom extension which passes through a slot in said shelf and contacts said further shield under said shelf.

11. An electrical connector according to claim 10, wherein said bottom extension contacts a tab portion bent upwardly from said further shield.

12. An electrical connector according to claim 10, wherein said bottom extension has at least one tab portion bent outwardly therefrom to lock against the underside of said shelf when said bottom extension is pressed through said slot.

13. An electrical connector according to claim 10, wherein said bottom extension is formed with a slot extending upwardly from the bottom thereof and wherein said further shield has a tab bent upwardly therefrom which fits in said slot.

14. A self shunting electrical connector comprising:

a housing, at least two pairs of connector elements extending in side by side relationship within said housing, one end of each of said connector elements being arranged to be electrically connected to a wire from a cable extending to said housing, the other end of each connector element being bent back to form a deflectable tongue which, when connected to a mating connector element, becomes deflected by a contact of said mating connector element, an insulative block extending across each of said connector elements between their respective ends, first and second switch contacts mounted on said insulative block and extending over the ends of only first and second ones of said tongues to make electrical contact therewith in the undeflected position of said tongues but not in their deflected position, and circuit segments on said insulative block, said segments forming a first permanent, non-breakable circuit connection between said first switch contact and one of the connector elements whose tongue does not contact a switch contact and a second permanent, non-breakable circuit connection between said second switch contact and the other connector element whose tongue does not contact a switch contact.

15. A self shunting electrical connector according to claim 14, wherein said first and second switch contacts are mounted to contact the tongues of the connector elements that are farthest from each other.

16. A self shunting electrical connector according to claim 15, wherein the circuit segments include first and second segments on an upper surface of said block in electrical contact, respectively, with said first and second switch contacts.

17. A self shunting electrical connector according to claim 16, wherein the circuit segments include third and fourth segments on a lower surface of said block in electrical contact, respectively, with said one and with said other of said connector elements whose tongue does not contact a switch contact.

18. A self shunting electrical connector according to claim 17, wherein said first and fourth segments are electrically connected to each other through said block and wherein said second and third segments are electrically connected to each other through said block.

19. A self shunting electrical connector according to claim 18, wherein said one of said connector elements whose tongue does not contact a switch contact is adjacent the connector element whose tongue contacts said first switch contact and wherein said other of said connector elements whose tongue does not contact a switch contact is adjacent the connector element whose tongue contacts said second switch contact.

20. A self shunting electrical connector according to claim 14, wherein an electrically conductive shield is interposed between the first and second pairs of connector elements and shields each pair of connector elements from crosstalk from the other pair.

21. A self shunting electrical connector according to claim 20, wherein said shield has a surface which extends over substantially the entire mutually projected area of the connector elements of each pair.

22. A self shunting electrical connector according to claim 21, wherein said shield has an opening therein to accommodate said insulative block.

23. A self shunting electrical connector according to claim 14, wherein said circuit segments are printed circuit segments.

24. A self shunting electrical connector according to claim 14, wherein said circuit elements are electrically conductive elements mounted on said insulative block and wherein said elements are supported by said block out of contact with said connector elements.

25. A self shunting electrical connector according to claim 24, wherein the portions of said electrically conductive elements under said insulative block extend along recesses formed in the underside of said block.

26. A self shunting electrical connector according to claim 24, wherein said circuit elements have tabs bent downwardly from under said insulative block to contact, respectively, different ones of said connector elements.

* * * * *